United States Patent [19]

Strunz et al.

[11] 4,028,047

[45] June 7, 1977

[54] PHOTOELECTRIC START-STOP CONTROLS FOR GAS BURNER

[75] Inventors: Alfred Strunz, Rietberg; Jürgen Rohrer, Gutersloh, both of Germany

[73] Assignee: Firma Dr. Th. Wieland, Pforzheim, Germany

[22] Filed: Dec. 19, 1975

[21] Appl. No.: 642,571

[30] Foreign Application Priority Data

Dec. 21, 1974 Germany ..... 2460745

[52] U.S. Cl. ..... 431/355; 126/234; 126/238; 431/6; 431/79

[51] Int. Cl.[2] ..... F23D 13/40

[58] Field of Search ..... 431/6, 355, 79; 126/226, 234, 238

[56] References Cited

UNITED STATES PATENTS

| | | | |
|---|---|---|---|
| 736,321 | 8/1903 | Walther | 126/234 |
| 3,188,836 | 6/1965 | Kniebes | 431/18 |
| 3,723,045 | 3/1973 | Reese | 431/18 |

*Primary Examiner*—Edward G. Favors
*Attorney, Agent, or Firm*—Joseph A. Geiger

[57] ABSTRACT

A device for electrically starting and stopping the operation of a gas burner in response to the shadow of the user's hand holding an object to be heated, the device including a solenoid valve in the gas line and a dimmer circuit with a directional photoelectric sensor, a switching amplifier, and a valve relay controlling the solenoid valve. The dimmer circuit can be bypassed for continuous operation by means of a selector switch.

9 Claims, 2 Drawing Figures

PHOTOELECTRIC START-STOP CONTROLS FOR GAS BURNER

BACKGROUND OF THE INVENTION

1. Field of the Invention

The present invention relates to photoelectric switching apparatus, and more particularly to devices for automatically starting and stopping a gas burner, especially a bunsen burner, in response to the shading of a photoelectric control sensor from the ambient light, through the approach of a hand, for example.

2. Description of the Prior Art

The use of bench-type gas burners, especially of so-called bunsen burners, is common in professional laboratories such as dentist's laboratories, for example, as well as in chemical laboratories and various other places, where there is a need for an open gas burner. Generally, such a burner is used intermittently, depending upon the type of work being performed, but the burner has to be ready for immediate ignition in response to a simple control maneuver. For those periods of time, however, during which the burner is not in actual use, it is desirable to have the burner shut down, in order to avoid the unnecessary consumption of large amounts of fuel, and also in order to avoid both the unnecessary consumption of oxygen in the laboratory and the heat development which would result from a continuous operation. In most cases, the actual time of usage of such a burner is a small fraction of the total time of necessary burner readiness.

In an effort to achieve such an automatic starting and stopping action of a gas burner, it has already been suggested in the prior art to provide a shutoff valve in the gas supply line which leads to the burner, which valve is operable mechanically in a simple manner, as for instance through being contacted by the user's hand holding an object to be heated over the gas flame of the burner, the object being a tool, or a test tube, for example.

These known hand-operated gas burners have the short-coming that the user's hand needs to remain steady and in a fixed position, in order to hold the gas valve open, while the same hand also holds the object in question over the flame of the burner. For, as soon as the hand is removed from the gas valve, the latter closes under the action of a closing spring, thereby automatically stopping the burner. This manually operated start-stop burner control device thus does not allow for the user's hand to simultaneously shake the test tube as it is heated, or to rotate a tool or workpiece over the burner flame.

SUMMARY OF THE INVENTION

Underlying the present invention is the primary objective of devising improved start-stop controls for a gas burner, where the aforementioned shortcomings are effectively eliminated, so that the user's hand, holding an object over the burner flame, serves to control the starting and stopping action of the burner, but such control is not rigorously dependent upon the exact position of the user's hand. It should thus be possible for the hand holding the object being heated to perform certain movements during the heating operation.

The present invention proposes to attain the above objectives by suggesting a novel device for automatically starting and stopping a gas burner, especially a bunsen burner, through a contact-free, proximity action of the user's hand, the device being primarily characterized by the presence of a solenoid valve in the gas supply line which is adapted to respond to a dimmer switch whose photoelectric sensor is aimed at an ambient light source just outside the range of luminescence of the burner flame.

In a preferred embodiment of the invention, the bunsen burner and the photoelectirc cell of the dimmer switch are mounted side by side on top of a box-like housing which encloses the dimmer switch and various other circuitry and control components. Alternatively, the photoelectric cell may be made an integral part of a separate add-on unit containing the dimmer switch and other circuitry components, the add-on unit being arranged for quick connection to the gas supply line and bunsen burner.

As an additional advantageous feature of the present invention, the preferred embodiment thereof suggests a photoelectirc sensor which is mounted on the burner support by means of a universal-pivot mount, the mount being preferably in the form of a plug and jack connection.

The control circuitry of the preferred embodiment of the invention includes essentially three units: an a.c. adapter, the circuitry for the dimmer switch, and the solenoid valve. Between the a.c. adapter, which supplies a low-voltage d.c. current to the switching amplifier of the dimmer switch, and the solenoid valve is further arranged a selector switch by means of which it is possible to bypass the a.c. adapter and the dimmer switch, for a permanent actuation of the solenoid valve, thereby overriding the photoelectrically responsive start-stop controls.

The preferred embodiment of the invention further suggests that the responsiveness of the photoelectric sensor be restricted to a particular light direction through the arrangement of the photoelectric cell at the end of a light tube, whereby the latter is arranged for orientation in any desired direction, thanks to its earlier-mentioned universal-pivot mount on top of the housing.

BRIEF DESCRIPTION OF THE DRAWING

Further special features and advantages of the invention will become apparent from the description following below, when taken together with the accompanying drawing which illustrates, by way of example, a preferred embodiment of the invention, represented in the various figures as follows.

DESCRIPTION OF THE PREFERRED EMBODIMENT

Figure 1:
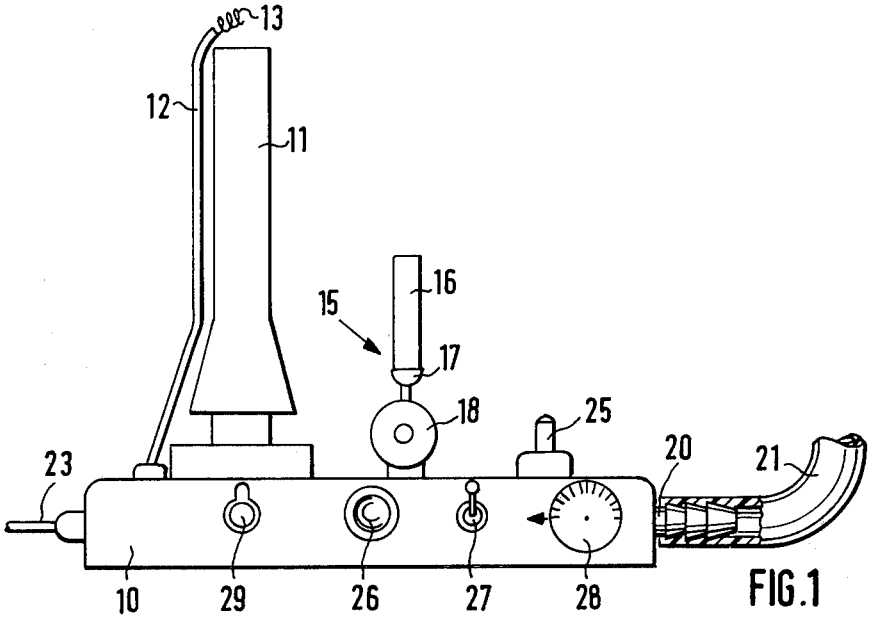
FIG. 1 shows the device of the invention in a somewhat schematic elevational representation.

Referring to FIG. 1 of the drawing, there is shown a box-like housing 10 for the accommodation therein of the various circuitry components of the device, while on top of it are mounted the bunsen burner 11 and a pilot tube 12 which carries a wire coil 13 at its upper extremity. A small pilot flame, fed through the pilot tube 12, maintains the coil 13 aglow. Also mounted on top of the housing 10, adjacent to the burner 11, is a photoelectric sensor 15, consisting of an upwardly oriented light tube 16 which carries a photoelectric cell 17 at its lower extremity. The sensor 15 is supported on the housing 10 by means of a universal pivot 18. The connection between the universal pivot 18 and the housing 10 is preferably a plug connection, a suitable socket being arranged in the housing 10. This plug connection may be of any conventional type and is therefore not specifically shown in the drawing.

One longitudinal end of the housing 10 carries a male connector 20 to which is attached the end of a flexible gas line 21. On the opposite end of the housing 10 is arranged a supply cord 23 whose free end carries a plug (not shown) for the connection of the device to a regular a.c. outlet. Various other control components are arranged on the front or on top of the housing 10. They include a push button main switch 25, a control light 26, a selector switch 27, and a light sensitivity knob 28. Just underneath the burner 11 is further arranged a knob 29 controlling a throttle valve for the adjustment of the gas flame.

Figure 2:
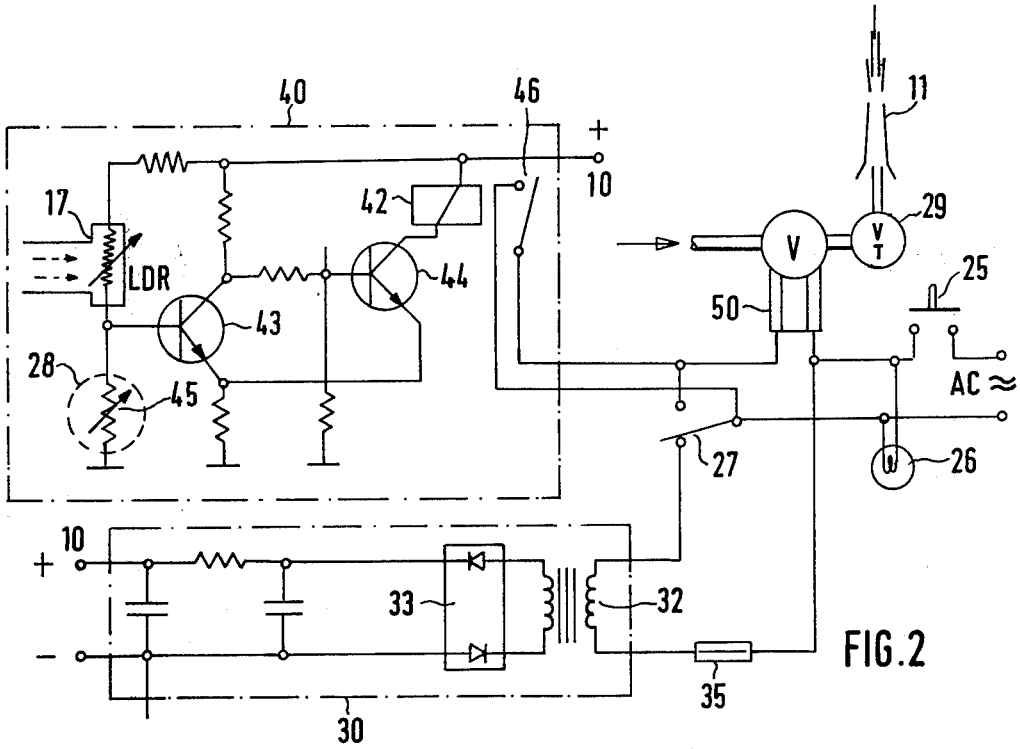
FIG. 2 shows a circuitry diagram for the device of FIG. 1.

The control circuitry of FIG. 2 consists essentially of an a.c. adapter unit 30 and a dimmer switch circuit 40, both units being indicated in FIG. 2 by stippled rectangles. The relay 42 of the dimmer switch circuit 40 controls the coil of a solenoid valve 50 in the gas supply line leading to the burner 11. The solenoid valve 50 is normally closed, but opens when its coil is energized. The selector switch 27, which is arranged ahead of the a.c. adapter 30, has a normal position, as shown, and a second position in which the valve relay 42 of the dimmer switch circuit 40 is shunted out, by directly closing the circuit of the solenoid valve 50 while disconnecting the a.c. adapter 30. In this second position of the selector switch 27, the photoelectirc controls are ineffective and the burner 11 operates continuously. The size of the burner flame is adjusted by means of the throttle valve 29. In FIG. 2 is further indicated the push button main switch 25 and the control light 26 at the entrance side of the a.c. portion of the circuitry. The latter is preferably regular 110-volt a.c. power. A fuse 35 protects the a.c. adapter unit 30.

The a.c. adapter unit 30 includes a power transformer 32 by means of which the line voltage is reduced to 12 volts, and a rectifier unit 33 converting the low-voltage alternative current into a 12-volt direct current.

The d.c. output of the a.c. adapter unit 30 is used to drive the switching amplifier of the dimmer switch circuit 40. The latter features two staggered transistors 43 and 44, the base potential of the first transistor 43 being controlled by the photoelectric cell 17. The latter represents a variable resistance changing in response to the amount of light impinging on it. In a branch line to the base circuit of the first transistor 43 is further arranged a second variable resistor 45, by means of which the interaction between the photoelectric cell 17 and the base of the first transistor 43 is variable in terms of the light differential which is needed to trigger the transistor 43. The conductive transistor 43, in turn, triggers the power transistor 44 which controls the coil circuit of the valve relay 42. The dimmer switch circuit 40 thus converts a certain drop in the intensity of light reaching the photoelectric cell 17 into a switching action of the valve relay 42 in the sense of automatically starting the operation of the burner 11. Conversely, the disappearance of this shadow above the photoelectric cell 17 causes the burner 11 to be automatically shut down again.

The operation and operational adjustments of the control device of the present invention are as follows: Following the connection of the device to the gas supply line 21 of a gas source such as bottled gas, for example, and following the connection of the cord 23 to an electrical outlet, the main switch 25 is operated. The on-condition of the device is indicated by the control light 26. While the throttle valve 29 of the burner 11 is still closed, the pilot flame at the top of the pilot tube 12 is ignited. Now, the light sensitivity knob 28 is rotated to its end position, in order to adjust the variable resistor 25 for a minimal light sensitivity of the photoelectric cell 17, and the light tube 16 of the sensor 15 is aimed against a light source, such as a room light fixture, or the window, for example, by swivelling it on its universal pivot 18.

The opening of the throttle valve 29 now starts the burner whose flame is automatically ignitied by the pilot flame. At this point, the light sensitivity knob 28 is rotated slowly in the opposite direction until the dimmer switch responds and the main flame of the burner 11 is shut down and only the pilot flame at the tip of the pilot tube 12 remains. It is recommended to turn the light sensitivity knob just a little bit further, in order to prevent accidental ignition of the burner in response to a small drop in the ambient light level. The controls are now adjusted for the automatic starting and stopping of the burner 11 in response to the appearance and disappearance of a shadow above the opening of the light tube 16. Such a shadow is conveniently produced by the user's hand holding the object to be heated.

The appearance of a shadow above the light tube 16 of the photoelectric sensor 15 reduces the resistance of the photoelectric cell 17 (FIG. 2), thereby increasing the potential of the base circuit of the transistor 43, so as to trigger the transistors 43 and 44 of the switching amplifier and thereby causing the valve relay 42 to respond by opening the solenoid valve 50 via contact 46. As soon as the shadow above the sensor 15 disappears again, the resistance of the cell 17 returns to the level at which the transistor 43 becomes non-conductive, causing the dimmer switch 40 to reverse itself and to shut down the burner 11 by de-energizing the valve relay 42 and by closing the solenoid valve 50. The light tube 16 of the photoelectric sensor 15 is preferably oriented towards a light source which is interrupted by the user's hand holding an object over the burner 11, without the need for the hand to be held in a narrowly limited predetermined position. This allows for a certain movement range of the hand, as when the tool or test tube is to be rotated or otherwise moved above the flame.

For the case in which it is desirable to have a continuously burning flame on the burner 11 regardless of the presense or absence of the user's hand, the device has a selector switch 27 (FIG. 2) by means of which the a.c. adapter 30 and the dimmer switch circuit 40 are disconnected and a direct circuit for the coil of the solenoid valve 50 is established with the a.c. power source.

It should be understood, of course, that the foregoing disclosure describes only a preferred embodiment of the invention and that it is intended to cover all changes and modifications of this example of the invention which fall within the scope of the appended claims.

We claim the following:

1. A device for electrically starting and stopping the operation of a bunsen burner, or of a comparable source-fed intermittently operable apparatus, in response to the presence in its immediate vicinity of and operator's hand holding an object to be heated by the burner, for example, the device comprising in combination:

a gas line adapted for connection to a source of combustible gas;

a solenoid valve in the gas line, the valve being normally closed and opening in response to the energization of the solenoid coil;

a connection to a source of electrical power for the operation of the solenoid valve; and a dimmer switch circuit with a valve relay controlling the solenoid valve; and wherein said circuit includes means for photoelectrically sensing the presence of the operator's hand in the vicinity of the burner, by responding to its shadow in an ambient light field other than the light field which is created by the gas burner when its flame is burning.

2. A burner control device as defined in claim 1, wherein:

the electrical power connection and the dimmer switch circuit, including its photoelectric sensing means, form an assembly;

said assembly and the solenoid valve form a compact portable structural unit; and the device further includes a housing enclosure for the aforementioned structural unit.

3. A burner control device as defined in claim 1, further comprising:

a housing serving as a base and support for the burner; and a gas connection on the housing as part of the gas line; and wherein the photoelectric sensing means includes a directional photoelectric sensor which is mounted on top of the housing; and the solenoid valve and various circuitry components of the dimmer switch circuit are arranged inside the housing, the dimmer switch circuit further including manually adjustable control members arranged on the outside of the housing.

4. A burner control device as defined in claim 3, wherein the photoelectric sensing means of the dimmer switch circuit includes a directional photoelectric sensor and means for reorienting the sensing direction of said sensor in at least two adjustment directions.

5. A burner control device as defined in claim 4, wherein the directional photoelectric sensor includes an upwardly open light tube and a photoelectric resistor cell arranged at the lower end of the tube; and the sensor reorienting means includes a universal pivot mount by means of which the sensor is mounted on the housing in the vicinity of the burner.

6. A burner control device as defined in claim 5, wherein the universal pivot mount includes disengageable connecting means in the form of a plug and socket connection between the universal pivot mount and the housing.

7. A burner control device as defined in claim 1, further comprising a selector switch interposed between said electrical power connection and the dimmer switch circuit; said selector switch having a first switching position in which the solenoid valve is controlled by the valve relay of the dimmer switch circuit, and a second switching position in which the dimmer switch circuit is bypassed and the solenoid valve is linked directly with said electrical connection for a continuous activation of the solenoid valve.

8. A burner control device as defined in claim 1, wherein the dimmer switch circuit includes:

a switching amplifier with at least one transistor;

a photoelectric resistor cell in the base circuit of said transistor; and means for adjustably shunting said base circuit in such a way that the resistance level at which the photoelectric resistor cell triggers the transistor changes in accordance with the setting of said shunting means.

9. A burner control device as defined in claim 8, wherein said shunting means is a variable resistor which is branched to the transistor base circuit between the photoelectric resistor cell and the base of the transistor.

* * * * *